US005632204A

United States Patent [19]

Lewis

[11] Patent Number: 5,632,204

[45] Date of Patent: May 27, 1997

[54] THIN-METAL LITHOGRAPHIC PRINTING MEMBERS WITH INTEGRAL REFLECTIVE LAYERS

[75] Inventor: Thomas E. Lewis, E. Hampstead, N.H.

[73] Assignee: Presstek, Inc., Hudson, N.H.

[21] Appl. No.: 508,333

[22] Filed: Jul. 27, 1995

[51] Int. Cl.[6] ..... B41N 1/14

[52] U.S. Cl. ..... 101/453; 101/462

[58] Field of Search ..... 101/453, 454, 101/457, 462, 463.1, 465, 466, 467

[56] References Cited

U.S. PATENT DOCUMENTS

| | | | |
|---|---|---|---|
| 3,677,178 | 7/1972 | Gipe | 101/466 |
| 4,842,988 | 6/1989 | Herrmann et al. | 430/14 |
| 4,842,990 | 6/1989 | Herrmann et al. | 430/272 |
| 4,846,065 | 7/1989 | Mayrhofer et al. | 101/453 |
| 5,053,311 | 10/1991 | Makino et al. | 430/166 |
| 5,188,032 | 2/1993 | Lewis et al. | 101/453 |
| 5,339,737 | 8/1994 | Lewis et al. | 101/454 |
| 5,379,698 | 1/1995 | Nowak et al. | 101/454 |

FOREIGN PATENT DOCUMENTS 1050805 3/1979 Canada .

OTHER PUBLICATIONS

Leenders et al., *Research Disclosure* 131:19201 (Apr. 1980).

Nechiporenko et al., *Direct Method Of Producing Waterless Offset Plates By Controlled Laser Beam*, pp. 139–148.

*Primary Examiner*—Stephen R. Funk

*Attorney, Agent, or Firm*—Cesari and McKenna

[57] ABSTRACT

Laser-imageable lithographic printing members have thin metal imaging layers and layers thereunder that reflect imaging radiation. Radiation from an imaging pulse that passes through an imaging layer is returned to that layer, thereby augmenting the effective energy flux density. The constructions can include dimensionally stable base supports adhered to the reflective substrate by, for example, lamination.

11 Claims, 1 Drawing Sheet

THIN-METAL LITHOGRAPHIC PRINTING MEMBERS WITH INTEGRAL REFLECTIVE LAYERS

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

U.S. Pat. Nos. 5,339,737 and 5,379,698 disclose a variety of lithographic plate configurations for use with imaging apparatus that operate by laser discharge (see, e.g., U.S. Pat. No. 5,385,092 and U.S. application Ser. No. 08/376,766, the entire disclosures of which are hereby incorporated by reference). These include "wet" plates that utilize fountain solution during printing, and "dry" plates to which ink is applied directly.

All of the disclosed plate constructions incorporate materials that enhance the ablative efficiency of the laser beam. This avoids a shortcoming characteristic of some prior systems, which employ plate substances that do not heat rapidly or absorb significant amounts of radiation and, consequently, do not ablate (i.e., decompose into gases and volatile fragments) unless they are irradiated for relatively long intervals and/or receive high-power pulses. The disclosed plate materials are all solid and durable, enabling them to withstand the rigors of commercial printing and exhibit adequate useful lifespans.

In one disclosed embodiment, the plate construction includes a first layer, an imaging layer that ablates when exposed to a pulse of imaging (preferably infrared, or "IR") radiation, and a substrate underlying the imaging layer. The first, topmost layer is chosen for its affinity for (or repulsion of) ink or an ink-abhesive fluid, while the substrate is characterized by an affinity for (or repulsion of) ink or an ink-abhesive fluid opposite to that of the first layer. Exposure of the plate to a laser pulse ablates the imaging layer, weakening the topmost layer as well. As a result of ablation of the second layer, the weakened surface layer is no longer anchored to an underlying layer, and is easily removed in a post-imaging cleaning step. This creates an image spot having an affinity for ink or an ink-abhesive fluid differing from that of the unexposed first layer.

As disclosed in the '698 patent, a thin layer of metal, preferably titanium, can be used as an ablation medium. Destruction of the titanium layer, which intervenes between an overlying top layer and a substrate, leaves the top layer unanchored and therefore vulnerable to removal by cleaning. The '698 and '737 patents, whose entire disclosures are hereby incorporated by reference, also disclose lamination of the substrate to a sturdy metal support.

Metal imaging layers are well-suited to environments (such as plate-winding arrangements) that require substantial flexibility, since the metal can be applied at miniscule thicknesses. Titanium is preferred as a metal ablation medium because it offers a variety of advantages over other IR-absorptive metals. Titanium layers exhibit substantial resistance to handling damage, particularly when compared with metals such as aluminum, bismuth, chromium and zinc; this feature is important both to production, where damage to the imaging layer can occur prior to coating thereover of the top layer, and in the printing process itself where weak intermediate layers can reduce plate life. In the case of dry lithography, titanium further enhances plate life through resistance to interaction with ink-borne solvents that, over time, migrate through the top layer; other materials, such as organic layers, may exhibit permeability to such solvents and allow plate degradation. Moreover, silicone coatings applied to titanium layers tend to cure at faster rates and at lower temperatures (thereby avoiding thermal damage to the underlying substrate), require lower catalyst levels (thereby improving pot life) and, in the case of addition-cure silicones, exhibit "post-cure" cross-linking (in marked contrast, for example, to nickel, which can actually inhibit the initial cure). The latter property further enhances plate life, since more fully cured silicones exhibit superior durability, and also provides further resistance against ink-borne solvent migration. Post-cure cross-linking is also useful where the desire for high-speed coating (or the need to run at reduced temperatures to avoid thermal damage to the plate substrate) make full cure on the coating apparatus impracticable. Titanium also provides advantageous environmental and safety characteristics: its ablation does not produce measurable emission of gaseous byproducts, and environmental exposure presents minimal health concerns. Finally, titanium, like many other metals, exhibits some tendency to interact with oxygen during the deposition process (vacuum evaporation, electron-beam evaporation or sputtering); however, the lower oxides of titanium most likely to be formed in this manner (particularly TiO) are strong absorbers of near-IR imaging radiation. In contrast, the likely oxides of aluminum, zinc and bismuth are poor absorbers of such radiation.

Despite their advantage in many printing environments, metal imaging layers do exhibit one shortcoming relative to IR-absorptive polymeric layers: the latter can be loaded with radiation-absorptive materials (e.g., carbon-black pigment) that render the layer capable of absorbing nearly all incident energy from an imaging pulse. A titanium metal layer, by contrast, will absorb a smaller fraction of an imaging pulse, transmitting and reflecting at least some pulse energy. As a very rough example, my work suggests that a titanium layer produced in accordance with the '698 patent absorbs approximately 50% of an imaging pulse, transmitting about 30% and reflecting about 20%. By contrast, it is possible to design nitrocellulose imaging layers loaded with carbon black that absorb 90% or more of an imaging pulse.

The result of this limited absorption is the need for relatively high pulse energies. The laser-driven imaging apparatus noted above operates by focusing the laser beam to a desired spot size on the printing member. The power of the laser is chosen such that this spot possesses an energy density adequate to achieve ablation. Deviation from proper optical alignment (resulting from vertical movement above and below the focused distance) produces a broader spot, i.e., a less concentrated beam having a correspondingly smaller energy density. Depth-of-focus in this type of imaging apparatus refers to the tolerable deviation from the chosen spot size—that is, the maximum degree of beam spread that will still achieve ablation. Thus, delivered pulse energies can be increased to accommodate limited-absorption imaging layers by utilizing higher-powered lasers or by designing an optical system that will maintain a precise focus and thereby reduce the necessary depth-of-focus tolerance.

Neither of these options is desirable, however, since higher power requirements can substantially increase laser cost, while reducing depth-of-focus tolerance places substantial demands on mechanical design; the required precision is particularly difficult to maintain in rigorous commercial platemaking and, especially, printing environments.

A better approach is to increase the fraction of energy absorbed by the thin-metal imaging layer. In one type of construction, described in the '698 patent and also in U.S. Pat. No. 5,570,636 entitled LASER-IMAGEABLE LITHOGRAPHIC PRINTING MEMBERS WITH DIMENSIONALLY STABLE BASE SUPPORTS, radiation is reflected back into the thin-metal imaging layer by an underlying reflective metal layer. In this way, the energy transmitted through the imaging layer is reflected back into that layer, substantially increasing the net energy available for absorption.

Ordinarily, this type of construction requires an intervening layer between the imaging and reflective layers, since these tend to be thermally conductive. Direct application of a titanium imaging layer, for example, to an aluminum support will in most cases prevent formation of an image due to conduction of heat through the support, which prevents sufficient energy from building up in the titanium layer to cause its ablation. Such conduction loss is avoided in the laminated constructions contemplated in the '698 and '737 patents due to the presence of an intervening polymeric substrate and layer of laminating adhesive, and in the '636 patent (the entire disclosure of which is hereby incorporated by reference) by introduction of a thermally insulating layer between the reflective layer and the thin-metal imaging layer.

The need for a separate reflective layer not only adds material cost and manufacturing overhead to the final plate, but can reduce its flexibility. A flexible plate is essential for plate-winding arrangements such as those disclosed in U.S. Pat. No. 5,355,795 and U.S. application Ser. No. 08/435,094 (filed on May 4, 1995 and entitled REMOVABLE SUPPLY AND UPTAKE ASSEMBLIES FOR LITHOGRAPHIC PLATE MATERIAL). Indeed, the use of a heavy aluminum support to provide reflection capability, as described in the '636 patent, is fundamentally incompatible with such arrangements.

DESCRIPTION OF THE INVENTION

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
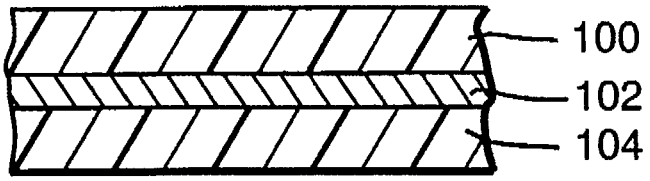
FIG. 1 is an enlarged sectional view of a lithographic plate having a top layer, a radiation-absorptive layer, and a substrate.

Refer to FIG. 1, which shows the construction of a printing plate or member in accordance with the present invention. As used herein, the terms "plate" and "member" refer to any type of printing member or surface capable of recording an image defined by regions exhibiting differential affinities for ink and/or fountain solution; suitable configurations include the traditional planar lithographic plates that are mounted on the plate cylinder of a printing press, but can also include cylinders (e.g., the roll surface of a plate cylinder), an endless belt, or other arrangement.

The illustrated member includes a polymeric surface layer 100, a thin metal layer 102 capable of absorbing imaging radiation, and a thermally non-dissipative substrate 104 that reflects imaging radiation. Layers 100 and 104 exhibit opposite affinities for fountain solution and/or ink. In a dry plate, layer 100 is "adhesive" or repellent to ink, while substrate 100 is oleophilic and therefore accepts ink. This construction facilitates radiation reflection without the need for a separate thermally insulating layer.

In order to avoid loss of laser energy into the substrate, thereby defeating the purpose of the invention, substrate 104 is thermally non-dissipative and also does not absorb significant amounts of impinging imaging radiation. In particular, preferred thermally non-dissipative materials exhibit inherent heat-transport rates much lower than that of a metal, and do not ablate in response to imaging radiation; such materials desirably have coefficients of thermal conductivity no greater than 1% of the coefficient for aluminum (0.565 cal/cm-sec-° C.), and include acrylic polymers (with a typical coefficient of 0.0005 cal/cm-sec-° C.) and polyethylene terephthalate (with a typical coefficient of 0.0004 cal/cm-sec-° C.), which provides the basis for most commercial polyester films. Although flexible polymeric materials are preferred, hybrid materials, which include flexible polymeric components and rigid inorganic components, can also be used to advantage in combination with reflective pigments, such as barium sulfate, dispersed therein. An example of such a hybrid material is a polysiloxane that includes an integral silicate structure within the polymer backbone.

In a dry-plate construction, layer 100 is oleophobic and layer 104 oleophilic. Suitable oleophobic materials for layer 100 include, for example, silicone and fluoropolymers; layer 104 can be, for example, a polyester material loaded with a pigment that reflects imaging radiation. Preferred polyester films for use as substrate 104 have surfaces to which the deposited metal adheres well, exhibit substantial flexibility to facilitate spooling and winding over the surface of a plate cylinder, and either reflect imaging radiation or, if an underlying layer reflects imaging radiation, are substantially transparent to imaging radiation. A material suitable for use as an IR-reflective substrate is the white 329 film supplied by ICI Films, Wilmington, Del., which utilizes IR-reflective barium sulfate as the white pigment. The polyester base retains its oleophilic affinity for ink.

In a wet plate, layer 100 is hydrophilic and accepts fountain solution, while layer 104 is both hydrophobic and oleophilic. Suitable hydrophilic materials for layer 100 include, for example, chemical species based on polyvinyl alcohol, while layer 104 can still be fabricated from any of the materials noted above.

In a preferred form of this construction, layer 102 is at least one very thin (preferably 250 Å or less) layer of a metal, preferably titanium, deposited onto a polyester substrate 104 loaded with an IR-reflective pigment. Exposure of this construction to a laser pulse ablates the thin metal layer and weakens the topmost layer and destroys its anchorage, rendering it easily removed. The detached topmost layer 100 (and any debris remaining from destruction of the imaging layer 102) is removed in a post-imaging cleaning step in accordance with, for example, U.S. Pat. Nos. 5,148,746 and 5,568,768.

Because such a thin metal layer may be discontinuous, it can be useful to add an adhesion-promoting layer to better anchor the surface layer to substrate 104, as described, for example, in the '698 patent. Suitable adhesion-promoting layers, sometimes termed print or coatability treatments, are furnished with various polyester films that may be used as substrates. For example, the J films marketed by E.I. dupont de Nemours Co., Wilmington, Del., and Melinex 453 sold by ICI Films, Wilmington, Del. serve adequately. Generally, the adhesion-promoting layer will be very thin (on the order of 1 micron or less in thickness) and, in the context of a polyester substrate, will be based on acrylic or polyvinylidene chloride systems. In addition, it should be substantially transparent to imaging radiation.

For traditional applications involving plates that are individually mounted to the plate cylinder of a press, the adhesion-promoting surface can also (or alternatively) be present on the side of the polyester film in contact with the cylinder. Plate cylinders are frequently fabricated from material with respect to which the adhesion-promoting surface exhibits a high static coefficient of friction, reducing the possibility of plate slippage during actual printing. The ICI 561 product and the dupont MYLAR J102 film have adhesion-promoting coatings applied to both surfaces, and are therefore well-suited to this environment.

The thin metal layer 102 is preferably deposited to an optical density ranging from 0.2 to 1.0, with a density of 0.6 being especially preferred. However, thicker layers characterized by optical densities as high as 2.5 can also be used to advantage. This range of optical densities generally corresponds to a thickness of 250 Å or less. While titanium is preferred as layer 102, alloys of titanium can also be used to advantage. The titanium or titanium alloy can also be combined with lower oxides of titanium.

Titanium, its alloys and oxides may be conveniently applied by well-known deposition techniques such as sputtering and electron-beam evaporation. Depending on the condition of the polyester surface, sputtering can prove particularly advantageous in the ready availability of co-processing techniques (e.g., glow discharge and back sputtering) that can be used to modify polyester prior to deposition.

Depending on requirements relating to imaging speed and laser power, it may prove advantageous to provide the thin metal layer with an antireflective overlay to increase interaction with the imaging pulses. Suitable antireflective materials are well-known in the art, and include a variety of dielectrics (e.g., metal oxides and metal halides). Materials amenable to application in a vacuum can ease manufacture considerably, since both the metal and the antireflection coating can be applied in the same chamber by multiple-source techniques.

The surface layer 100 is preferably a silicone composition, for dry-plate constructions, or a polyvinyl alcohol composition in the case of a wet plate. Our preferred silicone formulation is that described in connection with Examples 1–7 of the '698 patent, applied to produce a uniform coating deposited at 2 g/m$^2$. The anchorage of coating layer 100 to thin metal layer 102 can be improved by the addition of an adhesion promoter, such as a silane composition (for silicone coatings) or a titanate composition (for polyvinyl-alcohol coatings).

Figure 2:
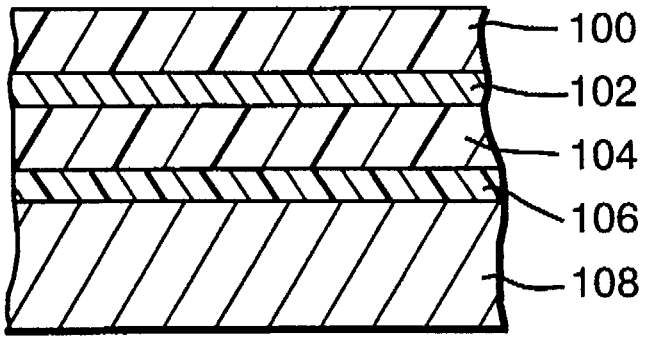
FIG. 2 is an enlarged sectional view of the construction shown in FIG. 1, wherein the substrate is laminated to a dimensionally stable support.

As shown in FIG. 2, substrate 104 may be anchored to a dimensionally stable base support 108 by means of a laminating adhesive 106. Preferably, layer 108 is a metal support. In a representative production sequence, a 2-mil, IR-reflective polyester film is coated with titanium and then silicone, following which the coated film is laminated onto an aluminum base having a thickness appropriate to the overall plate thickness desired.

Suitable techniques of lamination are well-characterized in the art (see, e.g., U.S. Pat. No. 5,188,032, the entire disclosure of which is hereby incorporated by reference), and are also discussed below. For production of printing members, it is preferred to utilize materials both for substrate 104 and for support 108 in roll (web) form. Accordingly, roll-nip laminating procedures are preferred. In this production sequence, one or both surfaces to be joined are coated with a laminating adhesive, and the surfaces are then brought together under pressure and, if appropriate, heat in the nip between cylindrical laminating rollers.

In an alternative embodiment, the laminating adhesive, rather than the substrate, reflects imaging radiation. Once again, this approach avoids the need for a separate reflecting layer, since the laminating adhesive is essential anyway. In this case, substrate 104 is transparent to imaging radiation. Materials suitable for use in this embodiment include the MELINEX 442 product marketed by ICI Films, Wilmington, Del., and the 3930 film product marketed by Hoechst-Celanese, Greer, S.C.

Laminating adhesives are materials that can be applied to a surface in an unreactive state, and which, after the surface is brought into contact with a second surface, react either spontaneously or under external influence. In the present context, a laminating adhesive should possess properties appropriate to the environment of the invention, anchoring substrate 104 to support 106 and accommodating the reflective material.

One category of suitable laminating adhesive is thermally activated, consisting of solid material that is reduced to a flowable (melted) state by application of heat; resolidification results in bonding of the layers (i.e., substrate 104 and support 108) between which the adhesive is sandwiched. In this embodiment, the reflective pigment is mixed with the solid adhesive prior to heating.

The mixture of adhesive and pigment may be applied as a solid (i.e., as a powder that is thermally fused into a continuous coating, or as a mixture of fluid components that are cured to a solid state following application) to one or both of the two surfaces to be joined; thus, a solid adhesive can be applied as a melt via extrusion coating at elevated temperatures, preferably at a thickness of 0.2–1.0 mil, although thinner and heavier layers can be utilized depending on the type of adhesive, application method and necessary bond strength. Following application, the adhesive is chilled and resolidified. Adhesives suitable for this approach include polyamides, copolymers of ethylene and vinyl acetate, and copolymers of ethylene and acrylic acid; specific formulas, including chemical modifications and additives that render the adhesive ideally suited to a particular application, are well-characterized in the art.

For this type of adhesive, barium sulfate can be incorporated as the reflective material in a loading range of 10–30% by weight, depending on the polymer and the application technique utilized. In a variation to this approach, the adhesive is applied as a waterborne composition with the pigment dispersed in suspension.

It may also prove useful to treat the application surface to promote wetting and adhesion of a waterborne adhesive. For example, in the case of a polyester substrate 104 that is to receive such a laminating adhesive, wettability can be improved by prior treatment with one or more polymers based on polyvinylidene dichloride.

In a third, preferred approach, the adhesive layer is cast from a solvent onto one or both of the two surfaces to be joined. This technique facilitates substantial control over the thickness of the applied layer over a wide range, and results in good overall surface contact and wetting onto the surface to which it is applied. Adhesives of this type can include cross-linking components to form stronger bonds and thereby improve cohesive strength, as well as to promote chemical bonding of the adhesive to at least one of the surfaces to be joined (ordinarily to a polymeric layer, such as a polyester substrate 104). They can also be formulated to include a reactive silane (i.e., a silane adhesion promoter) in order to chemically bond the adhesive to an aluminum support 108. Barium sulfate can be utilized in solvent-borne formulations such as these. One useful family of laminating adhesives that may be cast is based on polyester resins, applied as solvent solutions, and which include a cross-linking component.

An alternative to thermally activated laminating adhesives is the class of pressure-sensitive adhesives (PSAs). These are typically cast from a solvent onto the unprocessed side of substrate 104, dried to remove solvent, and finally laminated under pressure to a support. For example, the roll-nip laminating procedure described above can be utilized with no heat applied to either of the rollers. As in the case of thermally activated adhesives, post-application cross-linking capability can be included to improve bonding between surfaces and of the adhesive to the surfaces. The adhesive can also be applied, either in addition or as an alternative to application on substrate 104, to support 108. The PSA can be provided with additives to promote adhesion to support 108, to substrate 104, or to both. Like thermally activated adhesives, PSAs can be applied as solids, as waterborne compositions, or cast from solvents, exhibiting dye and pigment compatibilities as outlined above. Once again, pre-treatment of an application surface to enhance wettability may prove advantageous.

It will therefore be seen that I have developed an effective approach to use of imperfectly absorbing imaging layers in lithographic plate constructions that rely on radiation pulses for imaging. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A lithographic printing member directly imageable by laser discharge, the member comprising:

a. a topmost first layer; and b. a titanium layer, disposed thereunder, that ablatively absorbs imaging radiation; and c. a thermally non-dissipative substrate underlying the second layer, the substrate comprising a material that reflects imaging radiation, wherein d. the first layer and the substrate exhibit different affinities for at least one printing liquid selected from the group consisting of ink and an abhesive fluid for ink.

2. The member of claim 1 further comprising a dimensionally stable support to which the substrate is laminated.

3. The member of claim 2 wherein the support is metal.

4. The member of claim 3 wherein the metal is aluminum or an alloy of aluminum.

5. The member of claim 2 wherein the support is a metalized organic polymer.

6. The member of claim 1 wherein the first layer is oleophobic and the substrate is oleophilic.

7. The member of claim 1 wherein the first layer is hydrophilic and the substrate is hydrophobic.

8. A laminated lithographic printing member directly imageable by laser discharge, the member comprising:

a. a topmost first layer;

b. a second layer underlying the first layer and formed of a material subject to ablative absorption of imaging radiation whereas the first layer is not;

c. a third layer, substantially transparent to imaging radiation, underlying the second layer, the first and third layers exhibiting different affinities for at least one printing liquid selected from the group consisting of ink and an abhesive fluid for ink; and d. a support; and e. a layer of laminating adhesive anchoring the third layer to the support, the laminating adhesive comprising a material that reflects imaging radiation.

9. The member of claim 8 wherein the first layer is oleophobic and the third layer is oleophilic.

10. The member of claim 8 wherein the first layer is hydrophilic and the third layer is hydrophobic.

11. The member of claim 8 wherein the second layer is titanium or an alloy of titanium.

* * * * *